US009644917B1

(12) United States Patent
Fiebig

(10) Patent No.: US 9,644,917 B1
(45) Date of Patent: May 9, 2017

(54) TOOL FOR EXTRACTING STUCK GUN-CLEANING TOOLS

(71) Applicant: John Fiebig, Easton, PA (US)

(72) Inventor: John Fiebig, Easton, PA (US)

( * ) Notice: Subject to any disclaimer, the term of this patent is extended or adjusted under 35 U.S.C. 154(b) by 0 days.

(21) Appl. No.: 15/019,564

(22) Filed: Feb. 9, 2016

(51) Int. Cl.
*B66F 19/00* (2006.01)
*F41A 29/00* (2006.01)

(52) U.S. Cl.
CPC ..... *F41A 29/00* (2013.01); *B66F 19/00* (2013.01)

(58) Field of Classification Search
CPC ... B66F 19/00; B08B 9/00; B08B 9/02; B08B 9/04; F41A 29/00; F41A 29/02
USPC ..... 254/21, 25, 133 R; 269/3, 6, 95; 294/26, 294/175; 42/95
See application file for complete search history.

(56) References Cited

U.S. PATENT DOCUMENTS 1,435,647 A * 11/1922 McCanna ..... F41A 29/02 15/104.18
1,555,460 A * 9/1925 Cotta ..... F41A 29/02 15/104.16
2,547,273 A * 4/1951 Le Febvre ..... B65G 7/12 294/26
3,286,293 A * 11/1966 Eckert ..... F41A 29/02 15/104.16
3,326,254 A * 6/1967 Diehl ..... B25C 3/008 269/254 CS
3,380,092 A * 4/1968 Golczyuski ..... A43B 13/38 12/103
3,965,605 A * 6/1976 Allen ..... A01K 91/04 223/99
D302,787 S 8/1989 Wilson
5,075,998 A * 12/1991 Selleck ..... F41A 29/02 15/104.2
5,171,925 A * 12/1992 Mekler ..... F41A 29/02 15/104.165
5,337,505 A 8/1994 Brown
6,003,914 A * 12/1999 Brisbin ..... B25B 9/00 29/278
6,499,778 B2 12/2002 Boulay
RE38,247 E 9/2003 Wickser, Jr.
6,877,400 B2 * 4/2005 Weaver ..... B25B 9/00 269/6
8,448,370 B2 5/2013 Williams
8,695,264 B1 4/2014 Blackburn
8,793,918 B2 8/2014 Rogers
2002/0014776 A1 * 2/2002 Boulay ..... B25B 9/00 294/26
2003/0056810 A1 * 3/2003 Petit ..... E03C 1/302 134/8

(Continued)

FOREIGN PATENT DOCUMENTS

WO 2013022754 A1 2/2013

*Primary Examiner* — George Nguyen
(74) *Attorney, Agent, or Firm* — Kyle A. Fletcher, Esq.

(57) ABSTRACT

The tool for extracting stuck gun-cleaning tool is a device that is adapted for use with small arms. The tool for extracting stuck gun-cleaning tool is further adapted for use with a handle. The tool for extracting stuck gun-cleaning tool is a tool designed to be inserted in the barrel of a small arm. The tool for extracting stuck gun-cleaning tool captures and removes the remnants of broken small arm cleaning brushes that are left in the barrel of a small arm. The tool for extracting stuck gun-cleaning tool comprises a base and a shaft.

18 Claims, 3 Drawing Sheets

(56) References Cited

U.S. PATENT DOCUMENTS

| | | | | |
|---|---|---|---|---|
| 2006/0103150 | A1* | 5/2006 | Leonard | B08B 1/00 294/26 |
| 2008/0035900 | A1* | 2/2008 | Flores | B25B 33/00 254/21 |
| 2010/0303602 | A1* | 12/2010 | Murphy | E04H 4/1272 414/810 |
| 2010/0308288 | A1* | 12/2010 | Vincent | C22B 9/023 254/133 R |
| 2011/0031455 | A1* | 2/2011 | Mooney | A47G 27/0487 254/133 R |
| 2015/0015012 | A1* | 1/2015 | Coleman | B25G 1/04 294/175 |
| 2015/0042115 | A1* | 2/2015 | Hayes | B62D 53/0857 294/175 |

* cited by examiner

TOOL FOR EXTRACTING STUCK GUN-CLEANING TOOLS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of cleaning arrangements for small arms, more specifically, a tool configured for use in cleaning small arms.

SUMMARY OF INVENTION

The tool for extracting stuck gun-cleaning tool is a device that is adapted for use with small arms. The tool for extracting stuck gun-cleaning tool is further adapted for use with a handle. The tool for extracting stuck gun-cleaning tool is a tool designed to be inserted in the barrel of a small arm. The tool for extracting stuck gun-cleaning tool captures and removes the remnants of broken small arm cleaning brushes that are left in the barrel of a small arm.

These together with additional objects, features and advantages of the tool for extracting stuck gun-cleaning tool will be readily apparent to those of ordinary skill in the art upon reading the following detailed description of the presently preferred, but nonetheless illustrative, embodiments when taken in conjunction with the accompanying drawings.

In this respect, before explaining the current embodiments of the tool for extracting stuck gun-cleaning tool in detail, it is to be understood that the tool for extracting stuck gun-cleaning tool is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the tool for extracting stuck gun-cleaning tool.

It is therefore important that the claims be regarded as including such equivalent construction insofar as they do not depart from the spirit and scope of the tool for extracting stuck gun-cleaning tool. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
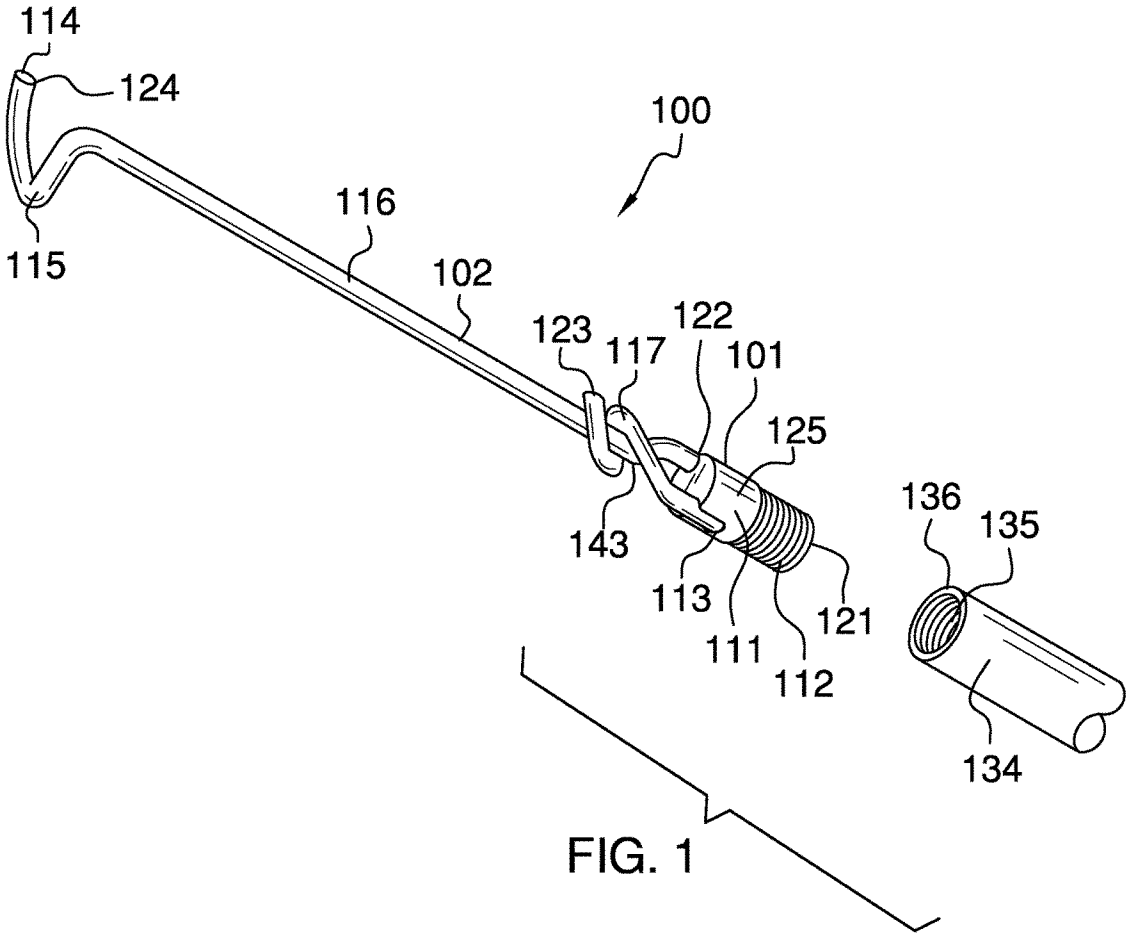
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 5.

The tool for extracting stuck gun-cleaning tool 100 (hereinafter invention) comprises a base 101 and a shaft 102. The invention 100 is a device that is adapted for use with small arms 131. The invention 100 is further adapted for use with a handle 134. The invention 100 is a tool designed to be inserted in the barrel 132 of a small arm 131. The invention 100 captures and removes the remnants of broken small arm 131 cleaning brushes 133 that are left in the barrel 132 of a small arm 131.

The base 101 is the portion of the invention 100 that is attached to a handle 134 during use. The base 101 further comprises a cylinder 111, an exterior screw thread 112, a post hole 113, and a pair of slotted grooves 177. The pair of slotted grooves 177 extends rearwardly from the posthole 113 on opposing sides of the cylinder 111. Moreover, the pair of slotted grooves 177 extend from the post hole 113 to the second end 122 of the cylinder 111. The cylinder 111 is a solid metal shaft. The cylinder 111 is further defined with a first end 121 and a second end 122. The first end 121 of the cylinder 111 is formed with an exterior screw thread 112. The face 125 of the cylinder 111 has the post hole 113 formed near the second end 122 of the cylinder 111. The post hole 113 is formed through the diameter of the cylinder 111. The post hole 113 is sized to receive the shaft 102. The relationship between the shaft 102, the pair of slotted grooves 177, and the post hole 113 is discussed elsewhere in this disclosure. The exterior screw thread 112 is adapted for use with a handle 134. The handle 134 is a grip that is attached to the invention 100 such that the invention 100 can be manipulated by hand. The handle 134 is fitted with a cylindrical hole 136 fitted with an interior screw thread 135. The size of the exterior screw thread 112 is selected such that the exterior screw thread 112 of the base 101 can be screwed into the interior screw thread 135 of the handle 134.

The shaft 102 is the portion of the invention 100 that is inserted in the barrel 132 of the small arm 131 to remove the remnant of the brush 133. The shaft 102 is a cylindrical bar. The shaft 102 further comprises a tail 114, a hook 115, a post 116, and a twist 117. The shaft 102 is further defined with a third end 123 and a fourth end 124. The hook 115 is bent into the fourth end 124 of the shaft 102. The tail 114 is a bevel that is formed at the actual physical fourth end 124 of the shaft 102. Projecting away from the hook 115 towards the handle 134 is the post 116. The post 116 provides the length of the invention 100. As shown most clearly in FIG. 3, the post 116 has a slight curvature to it such that the shaft 102 misaligns the center axis of the post 116 section of the shaft 102 with the center axis of the base 101. This misalignment away from the center axis of the base 101 towards the inner surface of the barrel 132 of the small arm 131 will help in dislodging the brush 133 from the small arm 131.

Figure 2:
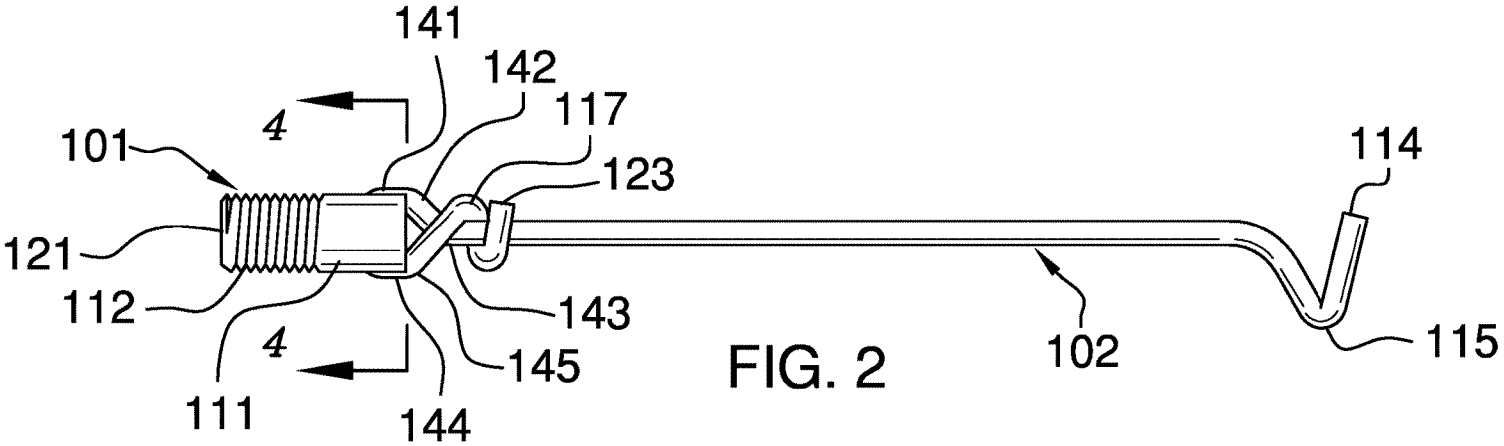
FIG. 2 is a side view of an embodiment of the disclosure.
Figure 3:
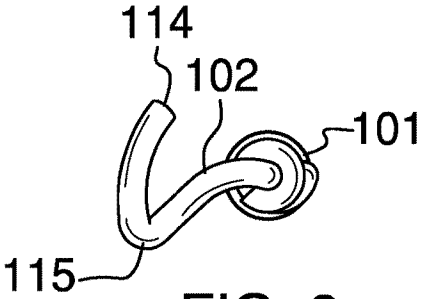
FIG. 3 is an end view of an embodiment of the disclosure.
Figure 4:
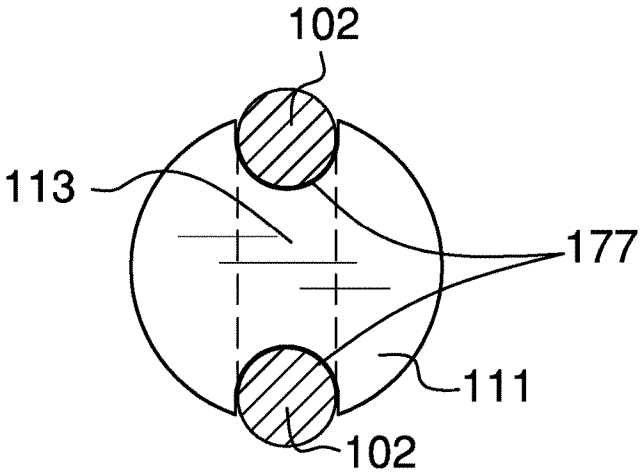
FIG. 4 is a cross-sectional view of an embodiment of the disclosure across 4-4 in FIG. 2.
Figure 5:
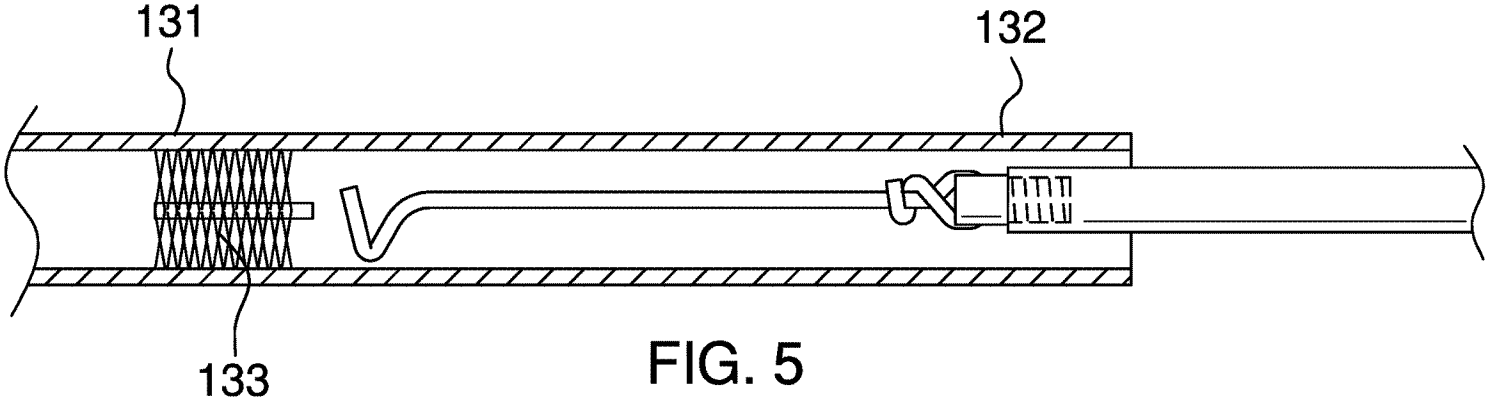
FIG. 5 is an in use view of an embodiment of the disclosure.

As shown most clearly in FIG. 2, to attach the shaft 102 to the base 101 the third end 123 of the shaft 102 is inserted through the post hole 113. A first bend 141 is then formed in the shaft 102 at the opening of the post hole 113 that is distal from the third end 123. The first bend 141 is a 90 degree bend. Moving from the first bend 141 toward the fourth end 124 of the shaft 102 a second bend 142 is formed in the shaft 102 at the second end 122 of the base 101 towards the center axis of the base 101. Moving further from the second bend 142 toward the fourth end 124 of the shaft 102 a third bend 143 is formed in the shaft 102 at line of the center axis of the base 101 that initially aligns the center axis of the shaft 102 with the center axis of the base 101. These center axes will misalign closer toward the fourth end 124. A fourth bend 144 is formed in the shaft 102 at the opening of the post hole 113 that is proximal to the third end 123. The fourth bend 144 is a 90 degree bend. Moving from the fourth bend 144 toward the fourth end 124 of the shaft 102 a fifth bend 145 is formed in the shaft 102 at the second end 122 of the base 101 towards shaft 102. As shown most clearly in FIG. 2, the third end 123 is wrapped around the shaft 102 in a formation referred to in this disclosure as the twist 117. After the first bend 141 and the fourth bend 144 are formed at a 90 degree bend from the post hole 113 towards the top of the second end 122 of the base 101, the shaft 102 is then pressed into the pair of slotted grooves 177 provided on the cylinder 111.

To use the invention 100, the base 101 is screwed into the handle 134. To remove the remnant of a brush 133 within the barrel 132 of a small arm 131, the tail 114 and the hook 115 of the shaft 102 are inserted into the barrel 132 of a small arm 131. When the tail 114 and the hook 115 of the shaft 102 reach the remnant of the brush 133 that remains in the barrel 132, the shaft 102 is angled such that the tail 114 of the shaft 102 is against the inner surface of the barrel 132. The tail 114 and hook 115 are then rotated around the interior surface of the barrel 132 of the small arm 131 with the intention of rotating the remnant of the brush 133 such that: 1) the remnant of the brush 133 is not attached to the barrel 132 of the small arm 131 and is able to freely rotate within the barrel 132 of the small arm 131; and 2) the tail 114 and the hook 115 are inserted a depth into the barrel 132 that is beyond the depth of the brush 133 such that the tail 114 and the hook 115 can hook the remnant of the brush 133 and pull the remnant of the brush 133 towards the handle 134.

The components discussed in this disclosure are commercially available. Methods to form exterior screw threads and drilling holes through cylindrical shafts are well known and documented in the art. Methods to bend and twist cylindrical shafts are well known and documented in the art.

The following definitions were used in this disclosure:

Exterior Screw Thread: An exterior screw thread is a ridge wrapped around the outer surface of a tube in the form of a helical structure that is used to convert rotational movement into linear movement.

Inner Diameter: As used in this disclosure, the term inner diameter is used in the same way that a plumber would refer to the inner diameter of a pipe.

Interior Screw Thread: An interior screw thread is a ridge wrapped around the inner surface of a tube in the form of a helical structure that is used to convert rotational movement into linear movement Outer Diameter: As used in this disclosure, the term outer diameter is used in the same way that a plumber would refer to the outer diameter of a pipe.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An apparatus comprising:

a base and a shaft;

wherein the apparatus is adapted for use with small arms;

wherein the apparatus is further adapted for use with a handle;

wherein the apparatus is a tool designed to be inserted in the barrel of the small arm;

wherein the apparatus captures and removes the remnants of broken small arm cleaning brushes;

wherein the base is attached to a handle during use;

wherein the base further comprises a cylinder, an exterior screw thread, a post hole; and a pair of slotted grooves.

2. The apparatus according to claim 1 wherein the cylinder is a solid metal shaft;

wherein the cylinder is further defined with a first end and a second end.

3. The apparatus according to claim 2, wherein the first end of the cylinder is formed with an exterior screw thread.

4. The apparatus according to claim 3 wherein the post hole is formed in the cylinder; wherein the post hole is formed through the diameter of the cylinder; wherein the post hole is sized to receive the shaft.

5. The apparatus according to claim 4 wherein the pair of slotted grooves extends rearwardly from the posthole on opposing sides of the cylinder.

6. The apparatus according to claim 5 wherein the pair of slotted grooves extend from the post hole to the second end of the cylinder.

7. The apparatus according to claim 6 wherein the shaft further comprises a tail, a hook, a post, and a twist;

wherein the shaft is further defined with a third end and a fourth end.

8. The apparatus according to claim 7 wherein the hook is a bend formed in the shaft.

9. The apparatus according to claim 8 wherein the tail is a bevel formed in the fourth end of the shaft.

10. The apparatus according to claim 9 wherein the post has a curvature to it such that the shaft misaligns with the center axis of the base.

11. The apparatus according to claim 10 wherein the third end of the shaft is inserted through the post hole.

12. The apparatus according to claim 11 wherein a first bend of ninety degrees is formed in the shaft at the opening of the post hole that is distal from the third end.

13. The apparatus according to claim 12 wherein a second bend is formed in the shaft between the first bend and the fourth end.

14. The apparatus according to claim 13 wherein a third bend is formed in the shaft between the second bend and the fourth end.

15. The apparatus according to claim 14 wherein a third bend is formed in the shaft between the second bend and the fourth end.

16. The apparatus according to claim 15 wherein a fourth bend of ninety degrees is formed in the shaft at the opening of the post hole that is proximal from the third end.

17. The apparatus according to claim 16 wherein a fifth bend is formed in the shaft between the fourth bend and the third end.

18. The apparatus according to claim 17 wherein a third end is wrapped around the shaft in a twist.

* * * * *